US005845466A

United States Patent [19]

Laudenberg

[11] Patent Number: 5,845,466

[45] Date of Patent: Dec. 8, 1998

[54] MULTIPLE PACKAGE MACHINE

[76] Inventor: Bernd Laudenberg, Bahnstrasse 27, D-51688 Wipperfurth, Germany

[21] Appl. No.: 970,679

[22] Filed: Nov. 14, 1997

[51] Int. Cl.[6] ..... B65B 9/06

[52] U.S. Cl. ..... 53/568; 53/550; 53/562; 53/570; 53/384.1

[58] Field of Search ..... 53/550, 562, 568, 53/570, 384.1

[56] References Cited

U.S. PATENT DOCUMENTS

| | | | |
|---|---|---|---|
| 3,479,930 | 11/1969 | Peppler | 53/562 |
| 3,871,157 | 3/1975 | Domke et al. | 53/562 |
| 4,172,349 | 10/1979 | Lipes | 53/384.1 |
| 4,411,123 | 10/1983 | Gautier | 53/568 |
| 4,617,785 | 10/1986 | Chikatani et al. | 53/562 |
| 4,956,964 | 9/1990 | Jones et al. | 53/562 |
| 5,182,898 | 2/1993 | Tung et al. | 53/384.1 |
| 5,315,807 | 5/1994 | Restle et al. | 53/562 |

*Primary Examiner*—Scott A. Smith
*Assistant Examiner*—John Paradiso
*Attorney, Agent, or Firm*—Gifford, Krass, Groh, Sprinkle, Patmore, Anderson & Citkowski, P.C.

[57] ABSTRACT

A multiple packaging machine for conducting simultaneous operations on two or more pouches at each of several work stations by employing a pair of clamps for holding each pouch at each station during opening by moving the clamps toward each other, during filling and during closing by moving the clamps away from each other.

17 Claims, 4 Drawing Sheets

MULTIPLE PACKAGE MACHINE

This application claims the benefit of U.S. Provisional Application No. 60/030,974 filed Nov. 15, 1996.

This invention relates to the method and machine for making and filling pouch-type packages and more particularly to increasing the capacity of existing horizontal type packaging machines.

It is well known in the horizontal packaging machinery industry that such machines are primarily designed to run in what is commonly referred to as the simplex mode. This is an arrangement by which single pouches are made, opened, filled and sealed. Many manufactures of such machinery modify their equipment to operate in what is known as the two-up mode or duplex mode. In this arrangement, two pouches instead of one are formed and handled at each station which doubles the output of the machine.

It is highly desirable to have a machine and method for handling three, four or even more pouches at each of the stations of a machine. By way of example; if a machine operates at 60 cycles per minute, operating a machine in a duplex mode results in 120 pouches per minute. In a triplex mode 180 pouches per minute would result and in a mode of four or even more, production would increase proportionately. Such an increase in production can be achieved with a relatively small investment by modifying an existing machine rather than purchasing multiple machines to obtain the same end results at a higher machinery and labor cost.

Prior art machines place limitation on the number of pouches that can be handled at a single station to two pouches because the clamping arrangements by which the pouches are held at each station usually require holding of the adjacent edges of adjacent pouches with a single clamp and the outer edges of the same pair of pouches with an additional pair of clamps making a total of three clamps to handle two pouches at each station. To open the pouches for filling, it is necessary for the pair of outer clamps to move toward each other to permit opening of the pouch. Such an arrangement is not usable with more than two pouches, for example, three or more pouches.

It is an object of this invention to provide a machine making it possible to convert a simplex machine to the handling of three or more pouches at each of its stations.

The purpose of the invention are achieved by pouch clamping arrangement by which a pair of clamps is used for each pouch at a single station. For example, if three bags are to be handled at a single station, three pairs of clamps are used with one clamp of each pair used at opposite edges of each pouch with all of the clamps attached to the left edges of pouches being actuated by a single mechanism and the clamp at the right edges by another, single mechanism and with all clamps simultaneously opened and closed by still another single mechanism.

DETAILED DESCRIPTION

The machine to which the present invention relates is referred to as a flat bag machine which, by way of example, can be of a type manufactured by Laudenberg Machinery, Inc., and generally designated as Model FBM-20. Such machines can be used for manufacturing a large variety of relatively flat pouches.

Figure 1:
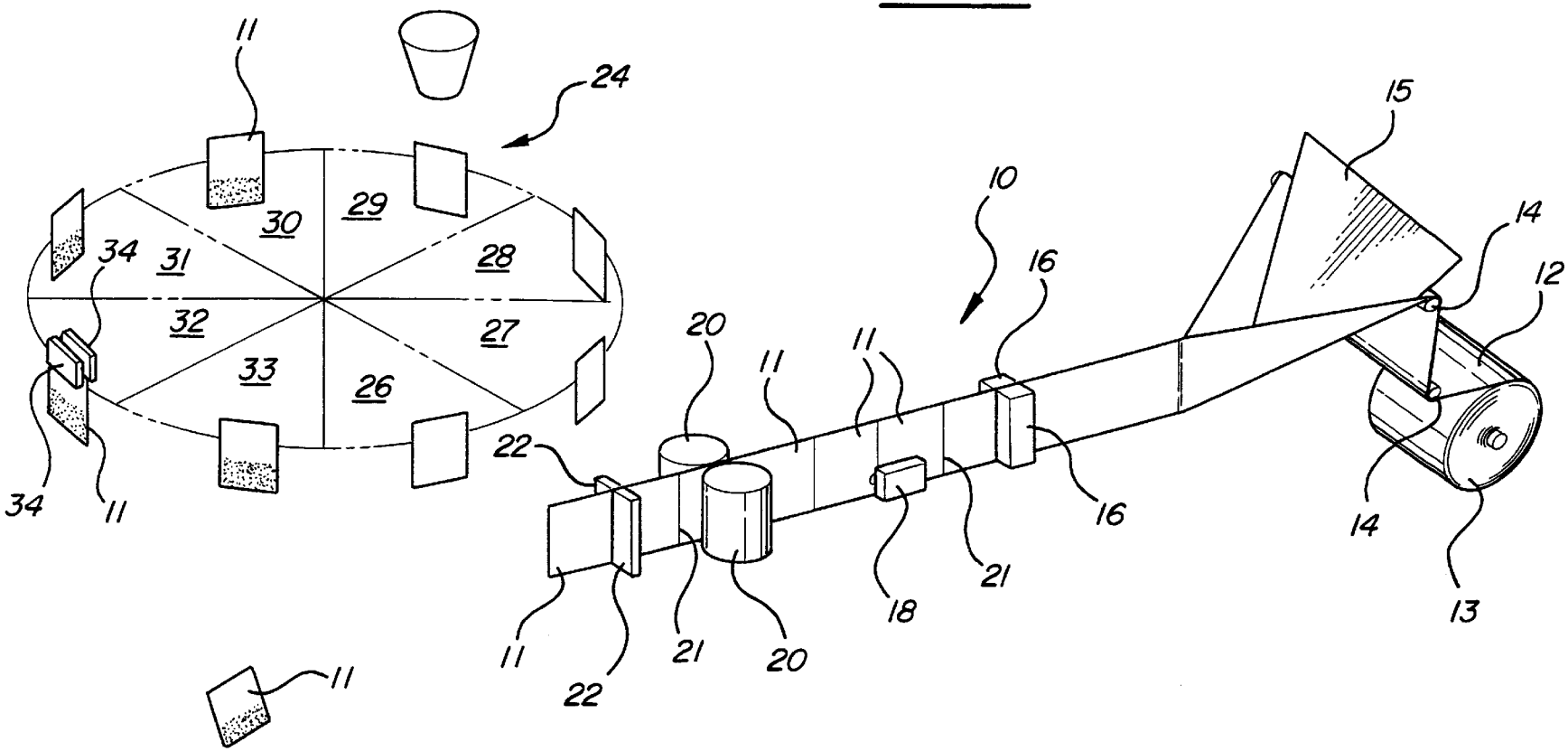
FIG. 1 is a diagrammatic, perspective view of a horizontal flat bag machine which the present invention relates.

Referring to FIG. 1, the flat bag machine 10 is used to make bags or pouches 11 from a flat, continuous sheet 12 of material which typically may be a plastic laminate stored on a roll 13 from which it is fed around guide bars 14 after which a plow member 15 is disposed in engagement with the top surface of sheet 12 to fold the sheet material so that the top surface forms surfaces facing each other. The facing surfaces are a sealant surface, usually of a plastic material which responds to heat to fuse and bond together with a like surface.

At a first station after folding, heated sealant bars 16 are brought into contact at opposite sides of the folded sheet of material 12 to fuse the facing sealant surfaces to each other. At a subsequent station, bottom sealing bars 18 are disposed at opposite sides of the sheet 12 to seal the bottom of the sheet and to form open pouches 11 which remain attached to each other. At a subsequent station, attached pouches 11 pass between rolls 20 which apply pressure to the opposite side to insure that the heated surfaces bond to each other. Thereafter, the pouches are cut along parting lines 21 formed by the heated bars 16 by shears designated at 22 to separate the pouches 11 from the string of pouches. Immediately thereafter, the pouches 11 are transferred to a rotating turret 24 which can consists of eight stations 26 through 33 making it possible to simultaneously conduct eight different operations such as; clamping and supporting the pouches 11, opening the upper portion of the pouches, forming or shaping the pouch opening, filling the open pouch with product, as shown in FIG. 1 at station 29, and sealing the open end of the filled pouch with opposed heating bars 34 at station 32, as seen in FIG. 1. At station 33, the filled and sealed pouch 11 can be transferred to a conveyer or the like for transport to a storage or shipping area.

The machine 10 described is for conducting a simplex operation in which one pouch is handled at each of the stations of the turret 24 at any one time. The same form of machine can be used for conducting duplex operations by which two bags are handled at each of the stations. This requires increasing number of cutting bars 20 and cutting knives 22 so that two packages can be transferred simultaneously to the first station 26 of the rotating turret 24.

Figure 2:
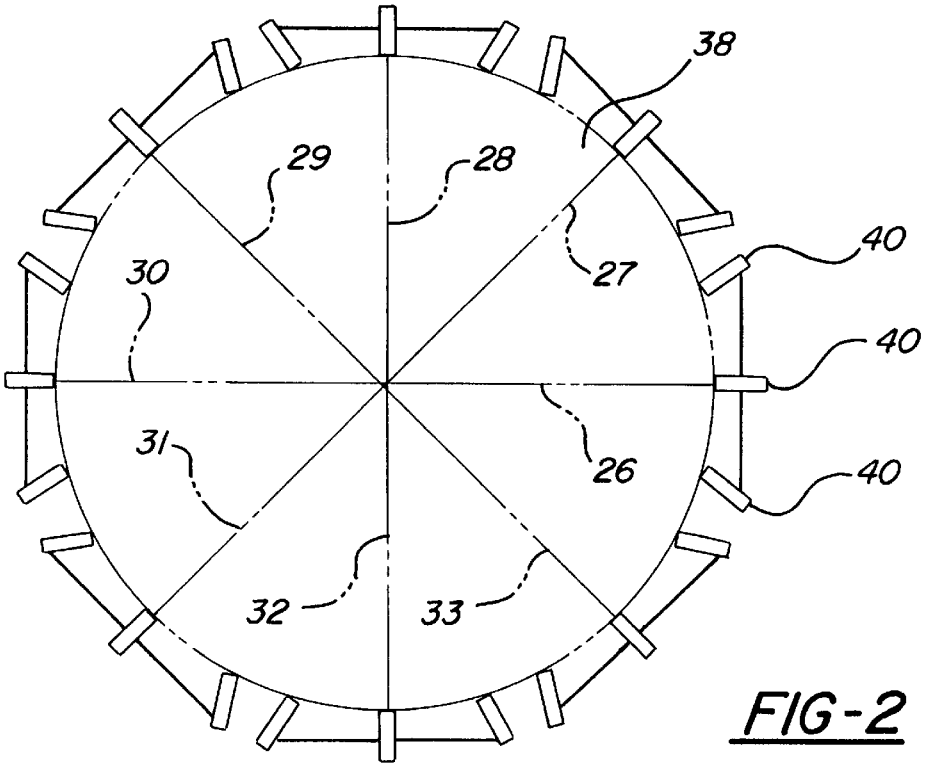
FIG. 2 is a top view of a turret of the type commonly used with the machine of FIG. 1.

Referring to FIG. 2, which illustrates a prior art turret 38 arrangement showing eight stations, three clamps 40 are used at each station for the purpose of handling two pouches. Each set of three clamps is disposed at a separate, single station the center of which is designated at 26 through 33.

Figure 3:
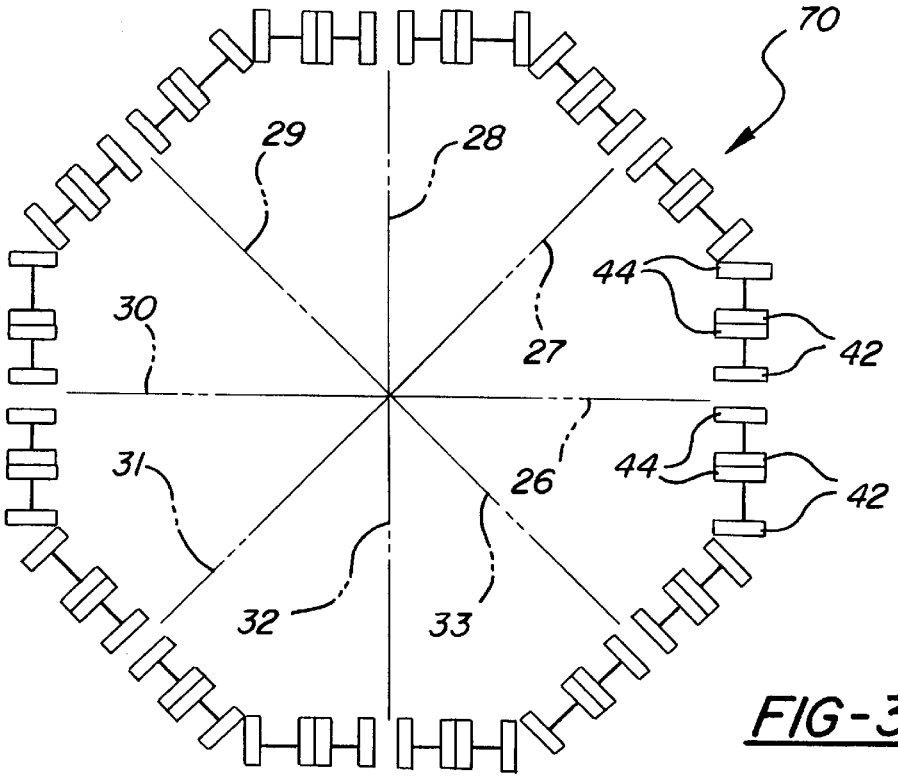
FIG. 3 is a top view of a turret of the type used in connection with the present invention.

The clamps 42 of the present invention are of a different form than the prior art clamps 40 and are used in pairs as seen in FIG. 3 with the left clamp being designated 42 and the right clamp designated 44. The clamps 42 and 44 must be capable of opening and closing and must be capable of moving toward and away from each other to allow a pouch to enter the holding area on the turret to be moved towards each other to clamp and hold the pouch. A third requirement for such clamps is that they must be movable towards each other when the package is clamped to cause the opening at the top of the package to attain its open condition.

Figure 4:
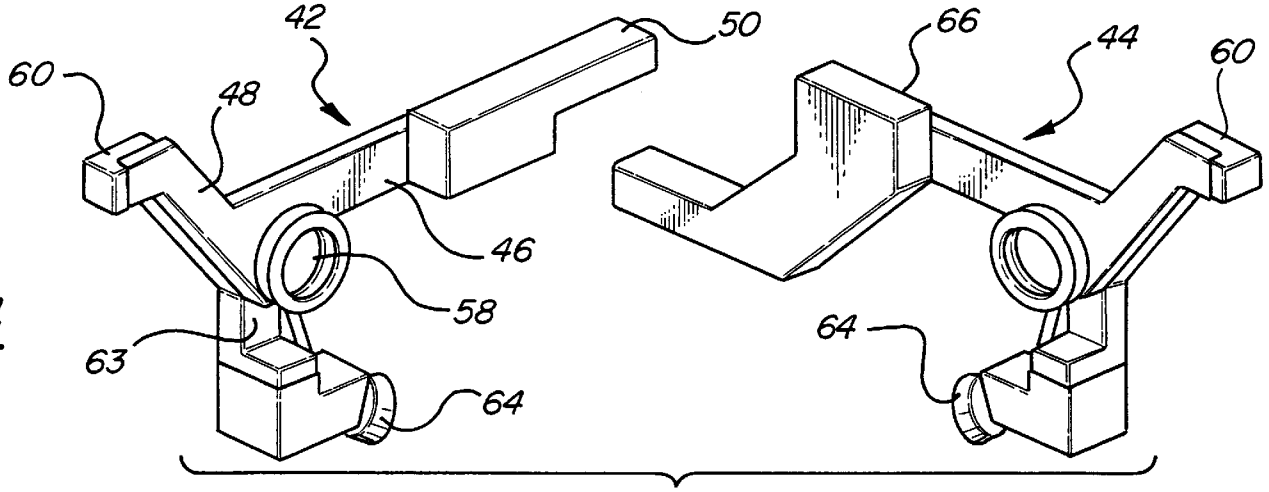
FIG. 4 is a perspective view of a pair of matching clamps forming part of the operating station of the turret seen in FIG. 3.
Figure 6:
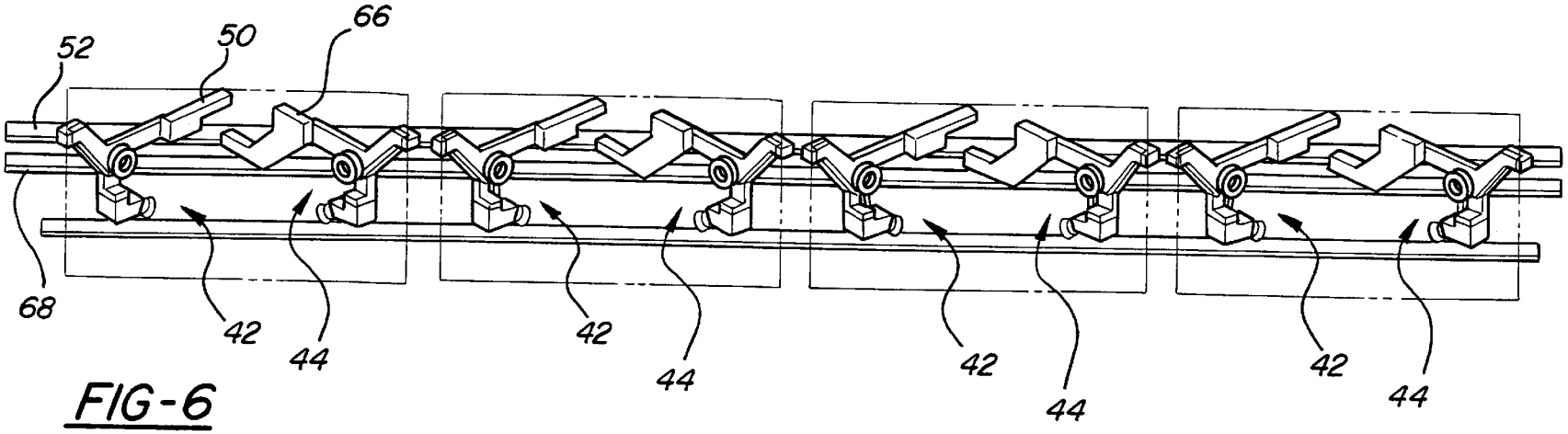
FIG. 6 is a view of four pairs of clamps used at one station of the turret seen in FIG. 3.
Figure 7:
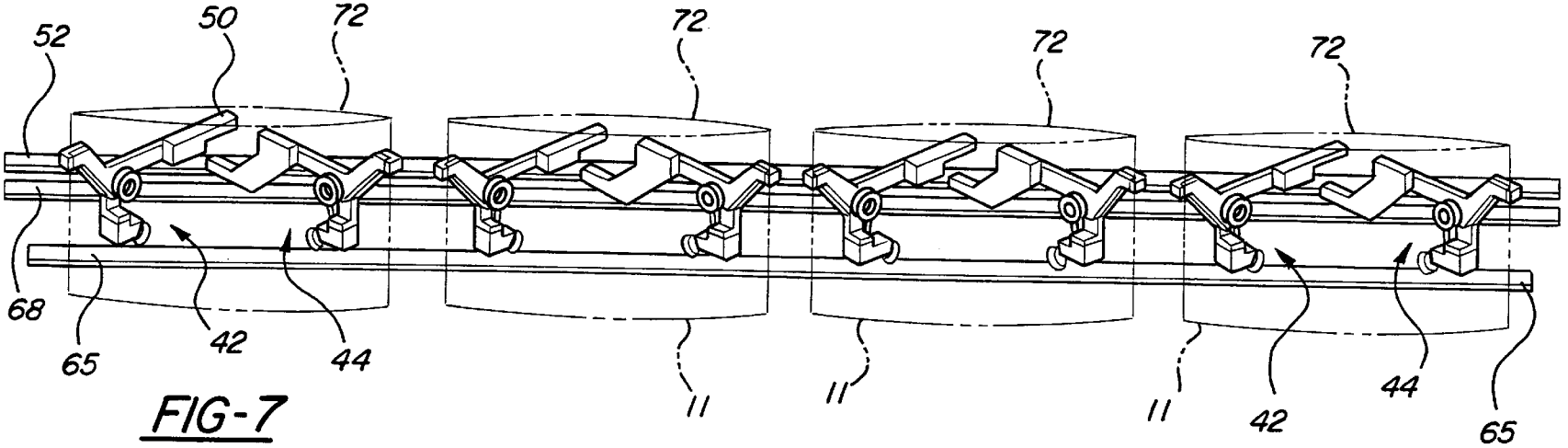
FIG. 7 is a view similar to FIG. 6 showing another operating condition of the clamps.

The left clamp 42 in FIG. 4 includes a horizontally extending base member 46 and upstanding finger 48 extending from one end of the horizontal base member 46. The other end of the base member 46 is provided with an adaptor 50 for attachment to an actuating bar 52, shown in FIGS. 6 and 7. The upstanding finger 48 provides a clamping surface 54 which engages the bag of the package when the clamp is in the closed position. The clamp 42 also includes a movable finger 56 which pivots about the axis of a pivot element 58 for movement between the closed position seen in FIG. 4 to the open position seen in FIG. 5. The upper end of the movable finger 56 is provided with an L-shaped clamping element 60 having a facing surface 62 for engagement with the clamping surface 54 to hold a pouch at one of its edges. An actuating arm 63 extends from the moveable finger 56 away from the pivot element 58. The free end of the actuating arm 60 is provided with a cam follower 64 which is engaged by a clamp cam bar 65, as seen in FIGS. 6 and 7, and is actuated by longitudinal movement to open and close all of the clamps 42.

The right hand clamp 44 is a mirror image of the left hand clamp 42 with one exception. This exception is an adaptor 66 having a different configuration than the adaptor 50. The adaptor 66 is rigidly connected to the right actuating bar 68, seen in FIGS. 6 and 7 for movement upon longitudinal movement of the bar 68. The free end of actuating arm 60 of clamp 44 also is provided with a cam follower 64 engaged with clamp cam bar 65 for opening and closing of claim 44 simultaneously with clamp 42.

Figure 5:
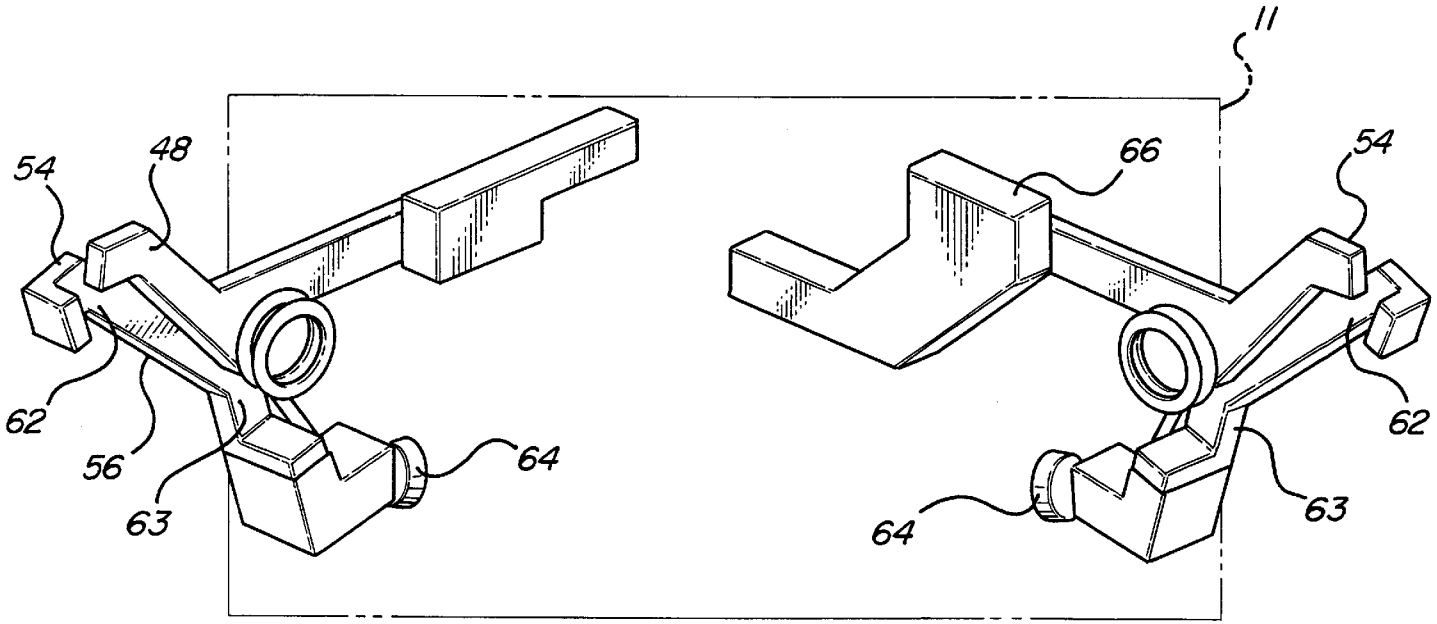
FIG. 5 is a view similar to FIG. 4 showing another operating condition of the clamps.

Four pairs of clamps each made up of a left clamp 42 and a right clamp 44 are disposed at each of the eight work stations designated at 27–31 in FIG. 3 on a turret or platform 70 seen in FIG. 5. The turret 70 typically is larger than the turrets of simplex or duplex machines to afford an additional space for forming three or more pouches. Otherwise, the size of pouches would be limited to very small sizes. In the case of four pouches at each station, all four of the left clamps 42 are connected by way of support means in the form of a left clamp bar 52 by way of the adapters 50 and all of the right hand clamps 44 are connected by support means formed by the right hand clamp bar 68 through adapters 66 so that all four pairs of clamps are supported near the perimeter of the turret 70 and can be moved as a unit. The left clamp bar 52 and the right clamp bar 68 are disposed substantially parallel to each other and are movable in opposite directions to result in moving the four clamps 42 and four clamps 44 away from each other or towards each other. Movement of the clamp cam bar 65 results in opening or closing movement of all four sets of the clamps 42 and 44 simultaneously.

A possible sequence of operation would be to simultaneously open all of the clamps 42 and 44 at a first station 26 and place a pouch 11 in alignment with each pair of open clamps in the spaces between the clamping surfaces 54 and 68. The clamp cam bar 65 can be actuated to close all eight of the clamps to securely hold four pouches 11. After turret 70 has been indexed to the next station, the left clamp bar 54 can be moved to the right and the right clamp bar 68 can be moved to the left simultaneously causing the clamps to converge. This results in the desired motion to provide an opening of the upper end of the pouch, as best seen at 72 in FIG. 7. After indexing turret 70, the open pouches can be filled at station 29. If desired, the pouches can be closed at station 30. At a subsequent station 32, the pouches can be heat sealed by moving the left and right clamps 42 and 44 away from each other. At the final station 33 of the turret 70, the clamp cam bar 64 can be actuated to simultaneously open all of the clamps to release the pouches for transfer to a transporting mechanism such as a conveyer belt or the like (not shown).

I claim:

1. A multiple package machine comprising:

a plurality of work stations, a plurality of pouch working positions formed at each of said work stations, a left and a right clamp at each of said pouch working positions for detachably holding opposed edges of a pouch adjacent the open end of said pouch, a first actuating member operatively connected to all of said clamps at a work station for simultaneously opening and closing all of said clamps, a left actuating member operatively connected to all of said left clamps at each work station for simultaneously moving all of said left clamps, a right actuating member operatively connected to all of said right clamps at each work station for simultaneously moving all of said right clamps, said left and right actuating members being moveable simultaneously in opposite direction to space said pairs of clamps apart to receive pouches therebetween and said first actuating member being moveable to open said clamps to receive said pouches and being movable to close said clamps to hold said pouches in position between said pairs of clamps.

2. The packaging machine of claim 1 wherein said left and right actuating members are movable to move said right and left clamps toward each other when said pouches are held by said clamps to open said pouches for filling.

3. The packaging machine of claim 1 wherein said left and right actuating members are movable to move said right and left clamps toward each other when pouches are held in said clamps to close said pouches.

4. The packaging machine of claim 1 wherein said work stations are formed on a rotatable platform.

5. The packaging machine of claim 4 wherein said rotatable platform is rotatable about a vertical axis.

6. The packaging machine of claim 1 wherein each of said right and left clamps include a stationary finger and a moveable finger moveable in response to movement of said first actuating member.

7. The packaging machine of claim 1 wherein each of said actuating members are elongated and are disposed in generally parallel relation to each other.

8. The packaging machine of claim 1 wherein said clamps are opened and closed at a first work station to receive and hold pouches and said right and left clamps are moved relative to each other at a subsequent work station to open said pouches.

9. The packaging machine of claim 8 wherein said right and left clamps are moved away from each other to close said pouches at a station following said subsequent station.

10. The packaging machine of claim 8 wherein said opened pouches are filled with material at a station following said subsequent work station.

11. A multiple package machine comprising:

a rotatable platform, a plurality of work stations formed on said platform, at least three pouch working stations at each of said work stations, first and second clamps at each of said pouch working stations for receiving and holding a pouch, an actuating member for simultaneously opening and closing all of said clamps at a work station, and support means for all of said clamps at a work station for simultaneous movement of said first and second clamps relative to each other and permitting movement of said first and second clamps away from each other at a first station to receive pouches therebetween, said actuating member being operative to open all of said clamps to receive pouches upon movement of said clamps toward each other and to close said clamps to support opposed edges of said pouches.

12. The packaging machine of claim 11 wherein said support means are operative when pouches are held by said clamps at a second station to move said clamps toward each other to open the tops of said pouches.

13. The packaging machine of claim 12 wherein said support means are operative at a third station to hold said pouches in their open position for filling with materials.

14. The packaging machine of claim 11 wherein said support means are operative when said pouches are held by said clamps at a fourth station to move said clamps away from each other to close said pouches.

15. The packaging machine of claim 11 wherein said rotatable platform rotates about a vertical axis.

16. The packaging machine of claim 11 wherein said pouch working stations are located at the perimeter of said platform.

17. The packaging machine of claim 11 wherein said support means include a first elongated member for said first claims and a second elongated member for said second clamps and wherein said members are disposed substantially parallel to each other.

* * * * *

UNITED STATES PATENT AND TRADEMARK OFFICE

CERTIFICATE OF CORRECTION

PATENT NO. : 5,845,466

DATED : December 8, 1998

INVENTOR(S) : MULTIPLE PACKAGE MACHINE

It is certified that error appears in the above-identified patent and that said Letters Patent is hereby corrected as shown below:

On the cover page, after [22] Filed: Nov. 14, 1997, insert --Related U.S. Application Data [60] Provisional Application No. 60/030,974, Nov. 15, 1996.--

Column 3, line 23, delete "claim" and insert --clamp--.

Column 6, line 9, delete "claims" and insert --clamps--.

Signed and Sealed this

Sixteenth Day of November, 1999

*Attest:*

Q. TODD DICKINSON

*Attesting Officer*

*Acting Commissioner of Patents and Trademarks*